US009147375B2

(12) United States Patent
Chen et al.

(10) Patent No.: US 9,147,375 B2
(45) Date of Patent: Sep. 29, 2015

(54) DISPLAY TIMING CONTROL CIRCUIT WITH ADJUSTABLE CLOCK DIVISOR AND METHOD THEREOF

(75) Inventors: Jian-Kao Chen, Hsinchu Hsien (TW); Chih Chiang Hsu, Hsinchu Hsien (TW)

(73) Assignee: MStar Semiconductor, Inc., Hsinchu Hsien (TW)

( * ) Notice: Subject to any disclaimer, the term of this patent is extended or adjusted under 35 U.S.C. 154(b) by 847 days.

(21) Appl. No.: 13/093,931

(22) Filed: Apr. 26, 2011

(65) Prior Publication Data

US 2012/0026156 A1 Feb. 2, 2012

(30) Foreign Application Priority Data

Jul. 27, 2010 (TW) ..... 99124623 A

(51) Int. Cl.
*G09G 5/00* (2006.01)
*G09G 5/12* (2006.01)

(52) U.S. Cl.
CPC ..... *G09G 5/005* (2013.01); *G09G 5/12* (2013.01); *G09G 2340/0407* (2013.01)

(58) Field of Classification Search
CPC ..... G09G 5/005; G09G 5/12
USPC ..... 345/3.4, 213
See application file for complete search history.

(56) References Cited

U.S. PATENT DOCUMENTS 6,441,658 B1 * 8/2002 Taraci et al. ..... 348/194
6,959,062 B1 * 10/2005 Stubbs ..... 375/376
7,773,153 B2 * 8/2010 FanChiang et al. ..... 348/512
2001/0055009 A1 * 12/2001 Zhang et al. ..... 345/204
2002/0041335 A1 * 4/2002 Taraci et al. ..... 348/511
2006/0071891 A1 * 4/2006 Anai ..... 345/87
2006/0170823 A1 * 8/2006 FanChiang et al. ..... 348/512
2007/0097263 A1 * 5/2007 Kim ..... 348/521
2007/0159263 A1 * 7/2007 Chou et al. ..... 331/16
2007/0159426 A1 * 7/2007 Shin ..... 345/87
2008/0239147 A1 * 10/2008 Kung et al. ..... 348/516

FOREIGN PATENT DOCUMENTS

CN 1960461 A 5/2007

OTHER PUBLICATIONS

Chinese Office Action dated Apr. 3, 2013, 6 pages.

* cited by examiner

*Primary Examiner* — Adam J Snyder
(74) *Attorney, Agent, or Firm* — Edell, Shapiro & Finnan, LLC

(57) ABSTRACT

A display timing control circuit is capable of rapidly adjusting display timing to achieve frame synchronization. The display timing control circuit includes an output pixel clock generator, a display timing generator, and a clock adjusting unit. The output pixel clock generator generates an output pixel clock signal according to a reference clock signal and a clock divisor. The display timing generator generates a display timing signal and an output vertical reference signal having an output frame rate according to the output pixel clock signal. The clock adjusting unit adjusts the clock divisor according to the output pixel clock signal, the output vertical reference signal, and an input vertical reference signal having an input frame rate.

19 Claims, 3 Drawing Sheets

DISPLAY TIMING CONTROL CIRCUIT WITH ADJUSTABLE CLOCK DIVISOR AND METHOD THEREOF

CROSS REFERENCE TO RELATED PATENT APPLICATION

This patent application is based on Taiwan, R.O.C. patent application No. 99124623 filed on Jul. 27, 2010.

FIELD OF THE INVENTION

The present invention relates to display timing control, and more particularly, to a display timing control circuit and method thereof.

BACKGROUND OF THE INVENTION

A conventional display apparatus needs to convert image data, e.g., input frames, received from a video signal source to output frames that may have a different resolution compared to the input frames, consistent with display timing determined by an internal display controller so as to display the output frames on a panel or screen. In order to achieve frame synchronization where output frame rate is synchronized with input frame rate, the conventional display apparatus adjusts an output vertical synchronous (output v-sync) signal needed for displaying the output frame according to an input vertical synchronous (input v-sync) signal provided by the video signal source. When a pulse of the input v-sync rises, a pulse of the output v-sync is synchronously generated which means the output v-sync is reset to force the output v-sync to be synchronized with the input v-sync. However, such an approach to display timing control may cause problems. For example, the output v-sync signal is forced to change in order to start the next cycle even though the present output cycle is not complete. As a result, the last few scan lines of the present output frame are not updated before the new cycle starts. For some low timing tolerance display devices, incomplete scan lines of frames can cause undesirable display effects.

SUMMARY OF THE INVENTION

In view of the foregoing issues, one object of the present invention is to provide a display timing control circuit and control method thereof capable of accurately adjusting display timing to achieve frame synchronization.

According to an embodiment of the present invention, a display timing control circuit comprises an output pixel clock generator, a display timing generator, and a clock adjusting unit. The output pixel clock generator generates an output pixel clock signal according to a reference clock signal and a clock divisor. The display timing generator coupled to the output pixel clock generator generates a display timing signal and an associated output vertical reference signal that has an output frame rate. The clock adjusting unit coupled to the output pixel clock generator and the display timing generator adjusts the clock divisor according to the output pixel clock signal, the output vertical reference signal and the input vertical reference signal, which corresponds to an input frame rate.

According to another embodiment of the present invention, a display timing control method comprises generating an output pixel clock signal according to a reference clock signal and a clock divisor; generating a display timing signal and an associated output vertical reference signal according to the output pixel clock signal that has an output frame rate; and adjusting the clock divisor according to the output pixel clock signal, the output vertical reference signal and an input vertical reference signal having an input frame rate.

DETAILED DESCRIPTION OF THE PREFERRED EMBODIMENT

Figure 1:
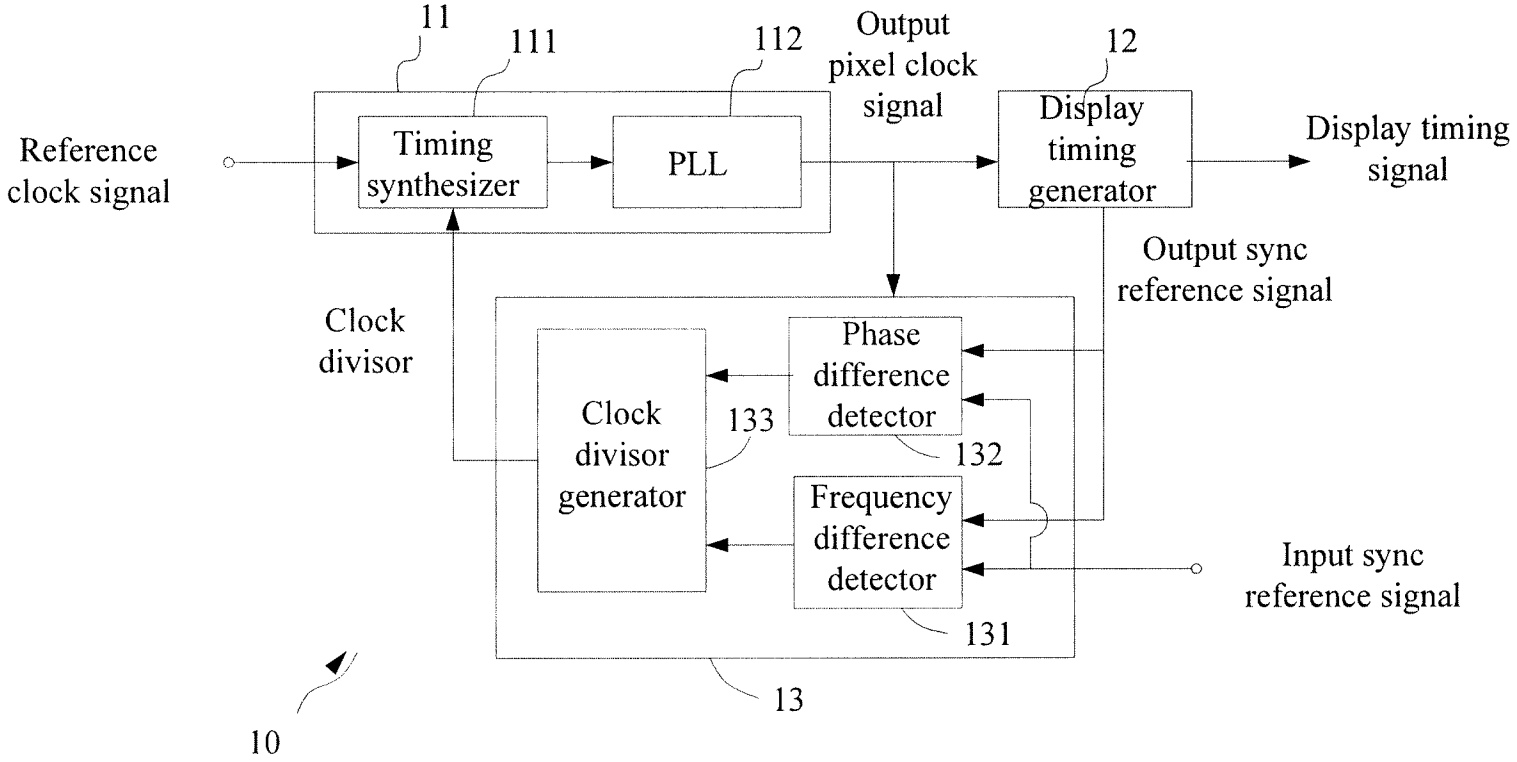
FIG. 1 is a block diagram of a display timing control circuit in accordance with an embodiment of the present invention.

FIG. 1 is a block diagram of a display timing control circuit 10 in accordance with an embodiment of the present invention. The display timing control circuit 10 comprises an output pixel clock generator 11, a display timing generator 12, and a clock adjusting unit 13. The display timing control circuit 10 is applied to a display apparatus to control display timing of output frames so that frame synchronization is maintained. For example, the display timing control circuit 10 may be integrated with a display controller and may provide an image scalar for scaling a timing signal for generating an output frame. The display timing control circuit 10 is applicable to different types of display devices, such as cathode ray tube (CRT) displays and televisions (TV), or liquid crystal displays (LCD) and TVs, and the like. The output pixel clock generator 11 comprises a clock synthesizer 111 and a phase lock loop (PLL) 112. The clock synthesizer 111 receives a reference clock signal, divides the reference clock signal in frequency domain by a clock divisor, and then transmits the divided reference clock signal to the PLL 112 to perform up-conversion of the frequency of the divided reference clock signal by a multiple, so as to generate an output pixel clock signal. For example, when the frequency of the reference clock signal is Fr, the clock divisor is n·f (n and f respectively represent an integer part and a fractional part) and the up-conversion multiple is M. As a result, frequency of the output pixel clock signal is Fr/n·f*M. It is noted that the clock synthesizer 111 can be a digital clock synthesizer.

The display timing generator 12 coupled to the PLL 112 generates a display timing signal and an associated output vertical reference signal according to the output pixel clock signal. The display timing signal comprises an output vertical synchronous (v-sync) signal, an output horizontal synchronous (h-sync) signal, and an output vertical data enable signal for determining display timing of an output frame. For example, assume a predetermined format of each output frame has V number of scan lines each comprising H number of pixels, and ith to jth scan lines of the output frame carry real image data of the frame. In this case, the display timing generator 12 outputs H output pixels together with each pulse of the output h-sync signal, and one pulse of the output v-sync signal is generated every V pulses of the output h-sync signal. The display timing generator 12 comprises a counter (not shown) for generating the display timing signal. The output vertical reference signal represents an output vertical valid area, and a frequency of the output vertical reference signal corresponds to an output frame rate.

The clock adjusting unit 13 receives the vertical reference signal and the input vertical reference signal to detect a frequency difference and a phase difference between them so as to determine adjustments of the clock divisor to eliminate the differences. The output vertical reference signal represents the output vertical active area, and the input vertical reference signal represents an input vertical active area associated with a video signal source (not shown). The differences may be caused by various types of factors, such as unstableness of the video signal source, switching between different video signal sources or a change of a TV channel. Similar to the output vertical reference signal, the input vertical reference signal is an input v-sync signal, an input vertical data enable signal, or a reference signal which has the same frequency and constant phase shift as the input v-sync signal or the input vertical data enable signal, and frequency of the input vertical reference signal is taken as the input frame rate. Therefore, when the input v-sync signal is regarded as the input vertical reference signal, the output v-sync signal is regarded as the output vertical reference signal accordingly; when the input vertical data enable signal is regarded as the input vertical reference signal, the output vertical data enable signal is regarded as the output vertical reference signal accordingly.

As shown in FIG. 1, the clock adjusting unit 13 comprises a frequency difference detector 131, a phase difference detector 132 and a clock divisor generator 133. The frequency difference detector 131 detects the frequency difference between the output vertical reference signal and the input vertical reference signal. Preferably, the frequency difference detector 131 determines the frequency difference according to a difference between a number of output pixel clocks 'A' in a cycle (period) of the input vertical reference signal and number of pixels in an output frame 'B'. Supposing that the cycle of the input vertical reference signal is $P_i$, the present cycle of the output vertical reference signal is $P_{o1}$, and the present cycle of the output pixel clock signal is $P_1$, then A, B can be calculated as $A=P_i/P_1$, $P_{o1}=P_1*B$, such that it is calculated that $B-A=(P_{o1}-P_i)/P_1$, which represents the frequency difference between the output vertical reference signal and the input vertical reference signal.

Because a goal of the display timing control circuit 10 is to synchronize the output frame rate with the input frame rate, the clock divisor generator 133 generates an updated value of the clock divisor when the frequency difference detector 131 detects the frequency difference, such that the output pixel clock generator 11 generates an updated output pixel clock signal, and thus a cycle of the updated output pixel clock signal generated by the display timing generator 12 is equal to the cycle (i.e., $P_i$) of the input vertical reference signal. Supposing that a current value and an updated value of the clock divisor are $D_0$ and $D_1$, respectively, the cycle of the output pixel clock signal is $P_2$, and the cycle of the updated output vertical reference signal is $P_{o2}$, because the clock divisor is directly proportional to the cycle of the output pixel clock signal, as well as $P_{o2}=P_i$, it is calculated as:

$$D_1/D_0=P_2/P_1=(P_{o2}/B)/(P_i/A)=A/B \quad (1)$$

$$D_1=D_0/B*A \quad (2)$$

Therefore, the updated value $D_1$ of the clock divisor is generated by dividing the current value $D_0$ of the clock divisor by a product of the number B of the pixels contained in an output frame and the number A of pixel clocks of one cycle of the input vertical reference signal.

The above mentioned Formula (2) is applicable to a condition where the display timing signal is consistent with non-interlaced display timing. When the display timing signal is interlaced, each input frame corresponds to two output frames, i.e., $P_{o2}=P_i/2$, so Formula (1) and Formula (2) are modified as:

$$D_1/D_0=P_2/P_1=(P_{o2}/B)/(P_i/A)=A/2B \quad (3)$$

$$D_1=D_0/2B*A \quad (4)$$

The display timing control circuit 10 is applicable to a situation in which a desired output frame rate is not synchronized with the input frame rate, where the desired output frame rate is user-defined or is defined according to requirements of specifications. In this regard, a conversion ratio R is ratio of the desired output frame rate and input frame rate, such that the cycle $P_{o2}$ of the updated output vertical reference signal is equal to a cycle $P_i/R$ of the input vertical reference signal. Therefore, Formula (1) and Formula (2) are modified as:

$$D_1/D_0=P_2/P_1=P_{o2}/B)/(P_i/A)=A/(R*B) \quad (5)$$

$$D_1=D_0/(R*B)*A \quad (6)$$

Therefore, according to Formula (2), Formula (4) and Formula 6, the clock divisor generator 133 calculates the update value of the clock divisor to revise the frequency of the output vertical reference signal instantly thereby achieving the desired output frame rate.

In this embodiment, the clock divisor generator 133 only generates the update value $D_1$ when the frequency difference is large, e.g., when the frequency difference is greater than a first threshold value. When the frequency difference is smaller than or equal to the first threshold value, the clock divisor generator 133 adjusts the clock divisor by compensating the phase difference to avoid frame jitter.

To achieve true frame synchronization, it is necessary that the phases and frequencies of the output vertical reference signal and the input vertical frequency signal are synchronized. The approach for eliminating the frequency difference is described above, and an approach for eliminating the phase difference is described below. In the clock adjusting unit 13, the phase difference detector 132 detects the phase difference between the vertical reference signal and the input vertical reference signal. In this embodiment, the phase difference detector 132 determines the phase difference according to the number of output pixels corresponding to an interval between an input reference time point (e.g., a time point of a pulse) of the input vertical reference signal and an output reference time point (e.g., a time point of another pulse) of the output vertical reference signal. For example, when the number of the output pixel clocks is counted from a start point of each output reference time point of the output vertical reference signal, a count value initialized from zero is added by 1 every output pixel clock is counted, so that the accumulated count value is the number B which is the pixels number of one output frame at a following output reference time point. At this point, the count value is reset to zero to count the number again. When the count value corresponding to the input reference time point of the input vertical reference signal is C, and the output reference time point is earlier than the input reference time point, the phase difference between the output vertical reference signal and the input vertical signal is C−B. When the output reference time point is later than the input reference time point, the phase difference is B−C. It is noted that the goal of the display timing generating circuit 10 is not to entirely or exactly synchronize the output vertical reference signal with the input vertical reference signal. For the display apparatus, input image data is buffered in an internal scan line buffer or a frame buffer, and the data is read from the scan line buffer or the frame buffer for output. Therefore, there is a time difference between the input image data and the output image data, which may cause that the output vertical reference signal to fall behind the input vertical reference signal by a fixed phase. Therefore, the following description of adjusting the clock divisor to eliminate the phase difference between the vertical reference signal and the input vertical reference signal is to maintain the output vertical reference signal falling behind the input vertical reference signal by the fixed phase difference.

The clock divisor generator 133 determines an adjustment amount of the clock divisor according to the phase difference detected by the phase difference detector 132. For example, when the phase difference is not significant, e.g., the phase difference is smaller than a second threshold value, it means that the phases of the output vertical reference signal and the input vertical reference signal are locked while the adjustment applied is a fine-tune adjustment amount for slightly adjusting phases of subsequent output vertical reference signal via the fine-tuned clock divisor to approximate the phase of the input vertical reference signal. Because it is calculated in Formula (2) that $D_1/A=D_0/B$, and A is the number of output pixels of one cycle of the input vertical reference signal, $D_0/B$ represents an adjustment amount of the clock divisor corresponding to a pixel unit, so that the phase difference is calculated based on the number of output pixels corresponding to an interval between the input reference time point and the output reference time point. Therefore, $D_0/B$ can be a unit of the fine-adjustment amount. When the phase difference is n (i.e., n output pixel clocks), the corresponding fine-adjustment amount is $D_0/B*n$. An advantage of the foregoing approach is that, the fine-adjustment amount can accurately react to the detected phase difference, to that the phases of subsequent vertical reference signals is accurately adjusted.

When the phase difference detected by the phase difference detector 132 is significant, e.g., the phase difference is larger than or equal to the second threshold value, it means that the phases of the output vertical reference signal and the input vertical reference signal are not locked. At this point, when the display apparatus allows phases of the display timing signal and the associated output vertical reference signal to be significantly changed, the clock adjusting unit 13 performs phase reconfiguration to directly synchronize a next output reference time point of the output vertical reference signal with a next input reference time point of the input vertical reference signal so that the phase difference is eliminated instantly. However, in the case when the display apparatus does not allow significant changes of the phases of the display timing signal and the output vertical reference signal, the clock adjusting unit 13 will have to gradually reduce the large phase difference by adjusting the clock divisor. Compared to the fine-adjustment amount implemented when the phase difference is not significant, the adjustment amount of the clock divisor is a coarse-adjustment amount. As mentioned above, the fine-adjustment amount is represented by $D_0/(B/n)$; thus, dividing the current value $D_0$ of the clock divisor with a value smaller than B/n results in a larger value than the fine adjustment amount. This value can be taken as the coarse-adjustment amount. The value smaller than B/n is a calculation of 2 to the power of n, where n is a positive integer.

More specifically, the clock divisor generator 133 changes the coarse-adjustment amount of the clock divisor following whether the phase difference swings over time. A swing of the phase difference refers to the fact that the phase difference detected by the phase difference detector 132 indicates that at one point in time the output vertical reference signal falls behind (or is ahead of) the input vertical reference signal, and at another point in time the output vertical reference signal is ahead of (or falls behind) the input vertical reference signal. These two situations are described below.

Figure 2:
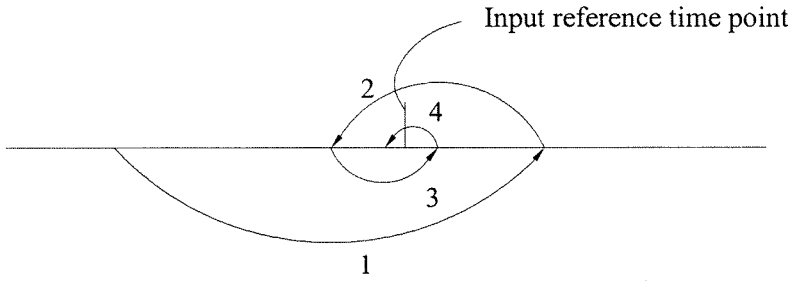
FIG. 2 is a schematic diagram of the clock divisor generator shown in FIG. 1 changing a coarse-adjustment amount of a clock divisor according to variations of phase differences in accordance with an embodiment of the present invention.

When the detected following phase difference is changed from positive to negative or from negative to positive, it means that the current coarse-adjustment amount is too large and thus the phase difference was reduced too much. At this point, it is necessary to reduce the coarse-adjustment amount of the clock divisor. For example, it is possible to reduce the coarse-adjustment amount to half of the previous value so that the phase difference can be reduced continuously and/or gradually. As shown in FIG. 2, a digit next to each arrow means the number adjustments of the clock divisor, and an arrow head and tail respectively represent positions of the output reference time point after and before adjustments with respect to the input reference time point. By application of the first coarse adjustment, the output reference time point changes from being behind to being ahead of the input reference time point; therefore, the second the coarse-adjustment amount can be reduced. As a result, after several iterations of the coarse-adjustments, the output reference time point rapidly approximates the input reference time point.

Figure 3:
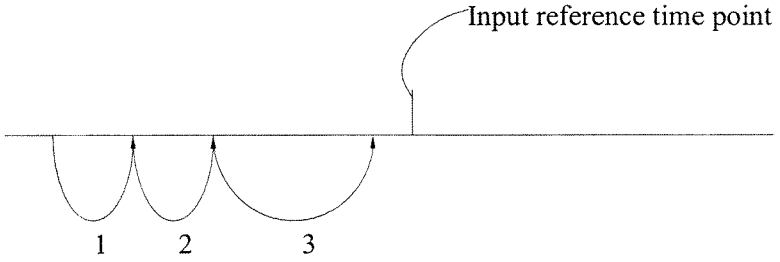
FIG. 3 is a schematic diagram of the clock divisor generator shown in FIG. 1 changing a coarse-adjustment amount of a clock divisor according to variations of phase differences in accordance with another embodiment of the present invention.

When the phase difference detected by the phase difference detector 132 following the first detection or the phase differences detected in several consecutive times (e.g., two consecutive times) do not change from positive to negative or from negative to positive, it means that the current coarse-adjustment amount is not large enough to achieve fast reduction of phase difference. At this point, it is necessary to increase the coarse-adjustment amount, such as increasing the coarse-adjustment amount as twice as much, to accelerate reduction of the phase difference. As shown in FIG. 3, when the first and second coarse-adjustment amounts do not change the output reference time point to be ahead of the input reference time point (i.e., a situation that the phase difference is not changed from negative to positive in two consecutive times is taken as an example in FIG. 3), the following third coarse-adjustment amount is increased more to achieve fast approximation.

The foregoing approach of changing the coarse-adjustment amount of the clock divisor can avoid a situation that the phase difference repeatedly changes between positive and negative and the difference is nevertheless not reduced.

Operations of the clock adjusting unit 13 addresses the following three situations:

(1) When the frequency difference detector 131 detects a very large frequency difference, it can mean the frequency difference is greater than the third threshold value which is greater than the first threshold. This may happen when the display apparatus switches to different video signal sources, and the clock divisor generator 133 directly transmits the update value $D_1$ of the clock divisor (the approach for generating the updated value $D_1$ is abovementioned) to the output pixel clock generator 11 so as to perform frequency reconfiguration, which allows fast synchronization of the output vertical reference signal and the input vertical reference signal. After that, elimination of the phase difference is performed.

(2) When the frequency difference detector 131 detects a moderate frequency difference, e.g., the frequency difference is smaller than the third threshold value and greater than the first threshold value, the clock divisor generator 133 adds the updated data $D_1$ of the clock divisor to the adjustment amount determined according to the phase difference detected by the phase difference detector 132, so as to generate and transmit an updated value $D_2$ of the clock divisor to the output pixel clock generator 11 thereby simultaneously eliminating the frequency difference and the phase difference.

(3) When the frequency difference is small, for example, the frequency difference is smaller than the first threshold value, the clock divisor generator 133 does not generate updated value $D_1$ of the clock divisor, but instead, it adds the current value $D_0$ of the clock divisor to the foregoing adjustment amount to generate the updated value $D_2$ of the clock divisor to the output pixel clock generator 11. In other words, the clock divisor generator 133 prompts the output vertical reference signal to track and lock the input vertical reference signal by eliminating the phase difference instead of directly processing the frequency difference (since the frequency difference is not large).

Under situations (2) and (3), when the phase difference continuously changes between positive and negative values and cannot be reduced to an acceptable difference range, the clock divisor generator 133 calculates an average value of the updated value $D_2$ and the current value $D_0$ to transmit to the output pixel clock generator 11 to obtain a more ideal clock divisor thereby obtaining subsequent smaller phase differences.

Figure 4:
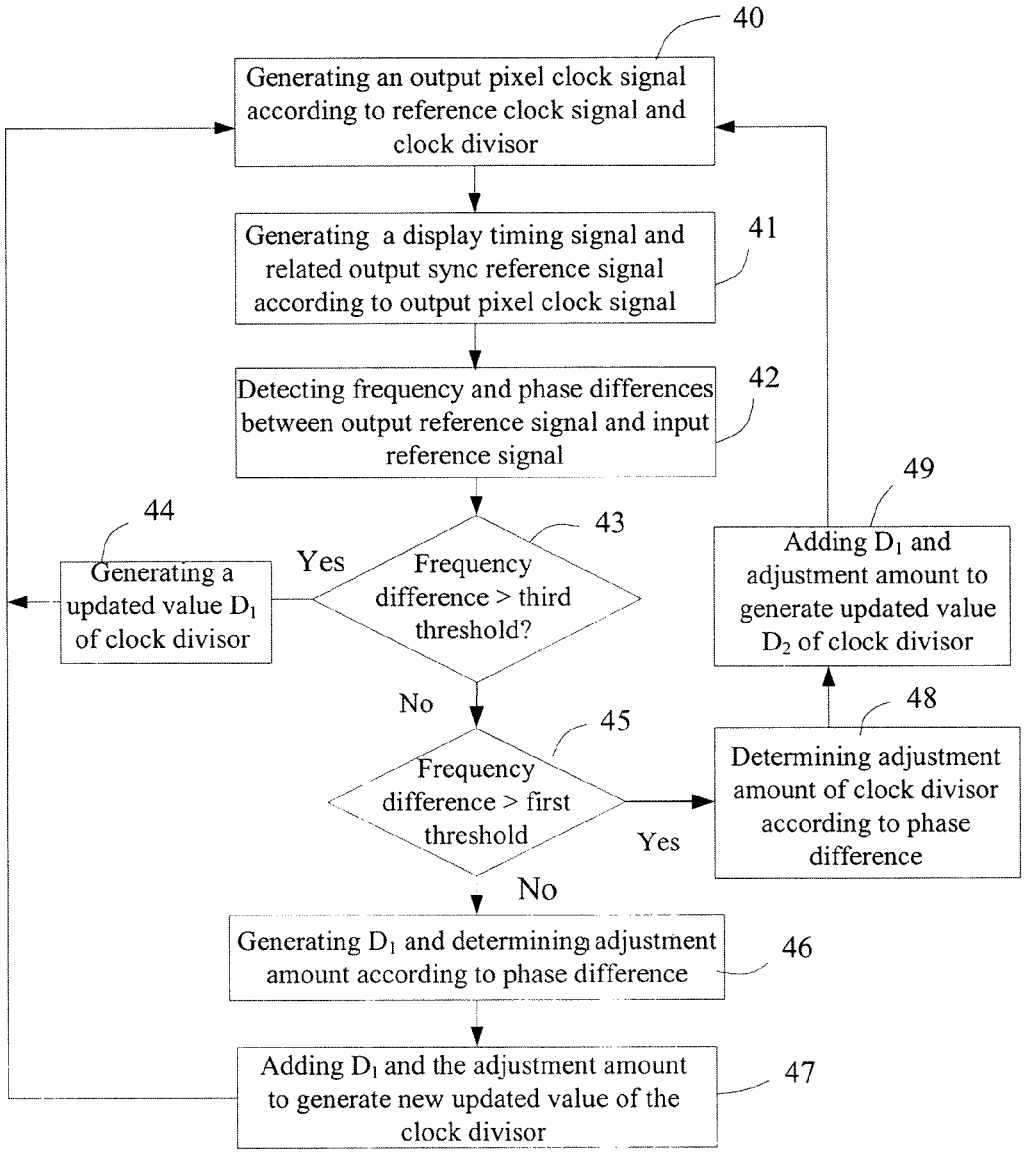
FIG. 4 is a flow chart of a display timing control method in accordance with an embodiment of the present invention.

FIG. 4 is a flow chart of a display timing control method in accordance with an embodiment of the present invention, and the method is applicable to different types of display devices, such as a CRT display and TV, or LCD display and TV, and the like. In Step 40, an output pixel clock signal is generated according to a reference clock signal and a clock divisor, e.g., a frequency of the output pixel clock signal is generated by multiplying a multiple by a result of dividing a frequency of the reference clock signal with the clock divisor.

In Step 41, a display timing signal and an associated output vertical reference signal are generated according to the output pixel clock signal, and the frequency of the output vertical reference signal is an output frame rate.

In Step 42, a frequency difference and a phase difference between the output vertical reference signal and an input vertical reference signal are respectively detected. A frequency of the input vertical reference signal is an input frame rate. Preferably, an input vertical data enable signal is regarded as the input vertical reference, and an output vertical data enable signal is regarded as the output vertical reference signal.

The frequency difference between the output vertical reference signal and the input vertical reference signal is determined according to a difference between the number of output pixels corresponding to a cycle of the input vertical reference signal and the number of pixels in an output frame. The phase difference is determined according to the number of output pixel clocks corresponding to an interval between an input reference time point of the input vertical reference signal and an output reference time point of the output vertical reference signal.

In Step 43, it is determined whether the frequency difference is greater than the third threshold, and the flow proceeds to Step 44 when the determination result is positive; otherwise, the flow proceeds to Step 45.

In Step 44, the updated value $D_1$ of the clock divisor is generated as an updated clock divisor, and the flow returns to Step 40. That is, Step 44 performs frequency reconfiguration. Two generating methods of the updated value $D_1$ are provided below.

When it is desired to synchronize the output frame rate with the input frame rate, the updated value $D_1$ is generated according to the current value $D_0$ of the clock divisor, number B of overall pixels in an output frame, and a number A of output pixel clocks corresponding to a cycle of the input vertical reference signal. When the display timing signal is non-interlaced display timing, the updated value $D_1$ is generated via Formula (2); when the display timing signal is interlaced display timing, the updated value $D_1$ is generated via Formula (4).

When it is desired to achieve a converting ratio of the output frame rate and the input frame rate to a predetermined ratio R, the updated value $D_1$ is generated via Formula (6).

In Step 45, it is determined whether the frequency difference is greater than a first threshold value that is smaller than a third threshold value. When the determination result is positive, the flow proceeds to Step 46; otherwise, the flow goes to Step 48.

In Step 46, the updated value $D_1$ of the clock divisor is generated (an approach for generating the updated value $D_1$ is described in Step 44), and an adjustment amount of the clock divisor is determined according to the phase difference. An approach for determining the adjustment amount is described below.

When the phase difference is greater than the second threshold value, the adjustment amount is a coarse-adjustment amount, which is generated from dividing the current $D_0$ of the clock divisor with a positive integer power of 2. More specifically, the coarse-adjustment amount is changed according to whether the phase difference generates positive and negative variations over time. For example, when a phase difference generated in a next iteration of Step 42 changes from positive to negative or from negative to positive, the coarse-adjustment amount is reduced; when a phase difference generated in the next iteration or the next N (N is larger than 1) consecutive iterations do not change from positive to negative or from negative to positive values, the coarse-adjustment amount is increased.

Another method can be applied when the phase difference is greater than a second threshold value. When the display apparatus allows phases of the display timing signal and the associated output vertical reference signal to vary significantly, the phase reconfiguration is directly performed in Step 46, which allows synchronization of a following output reference time point of the output vertical reference signal and a following input reference time point of the input vertical reference signal.

When the phase difference is not greater than the second threshold, the adjustment amount is a fine-adjustment amount. Unit of the fine adjustment is defined by the result of dividing the current value $D_0$ of the clock divisor by the number B of the overall pixels contained in an output frame. Therefore, when the phase difference is n (i.e., when there are n output pixel clocks), the corresponding fine-adjustment amount is $D_0/B*n$.

In Step 47, the updated value $D_1$ of the clock divisor generated in Step 46 is added to the adjustment amount to generate an updated value of the clock divisor as an updated clock divisor, and the flow returns to Step 40.

In Step 48, the adjustment amount of the clock divisor is determined according to the phase difference, and an approach for determining the adjustment amount is described in Step 46.

In Step 49, the current value $D_0$ of the clock divisor is added to the adjustment amount determined in Step 48 to generate the updated value $D_2$ of the clock divisor as the updated clock divisor, and the flow returns to Step 40. Alternatively, in Step 47 and Step 49, an average value of the updated value $D_2$ of the clock divisor and the current value $D_0$ of the clock divisor is generated.

While the invention has been described in terms of what is presently considered to be the most practical and preferred embodiments, it is to be understood that the invention needs not to be limited to the above embodiments. On the contrary, it is intended to cover various modifications and similar arrangements included within the spirit and scope of the appended claims which are to be accorded with the broadest interpretation so as to encompass all such modifications and similar structures.

What is claimed is:

1. A display timing control circuit, comprising:

an output pixel clock generator, for generating an output pixel clock signal according to a reference clock signal and a clock divisor;

a display timing generator, coupled to the output pixel clock generator, for generating a display timing signal and an output vertical reference signal according to the output pixel clock signal, with the output vertical reference signal having an output frame rate; and a clock adjusting unit, coupled to the output pixel clock generator and the display timing generator, for adjusting the clock divisor according to the output pixel clock signal, the output vertical reference signal, and an input vertical reference signal which has an input frame rate, wherein the clock adjusting unit comprises:

a frequency shift detector, for detecting a frequency shift between the output vertical reference signal and the input vertical reference signal;

a clock divisor generator, coupled to the frequency shift detector, for generating an updated value of the clock divisor according to the frequency shift; and a phase difference detector, coupled to the clock divisor generator, for detecting a phase difference between the output vertical reference signal and the input vertical reference signal, wherein the clock divisor generator determines a divisor adjustment amount of the clock divisor according to the phase difference.

2. The display timing control circuit as claimed in claim 1, wherein the display timing signal is an output vertical data enable signal, and the input vertical reference signal is an input vertical data enable signal.

3. The display timing control circuit as claimed in claim 1, wherein the clock adjusting unit generates an updated value of the clock divisor according to a current value of the clock divisor, number of pixels in an output frame, and number of clocks of the output pixel clock signal which is associated with one period of the input vertical reference signal, so as to synchronize the output frame rate with the input frame rate.

4. The display timing control circuit as claimed in claim 3, wherein when the display timing signal is non-interlaced display timing, the updated value of the clock divisor is generated from multiplying a result of dividing the current value of the clock divisor by the number of the pixels by the number of clocks.

5. The display timing control circuit as claimed in claim 3, wherein when the display timing signal is interlaced display timing, the updated value of the clock divisor is generated from multiplying a result of dividing the current value of the clock divisor by twice of the number of the pixels by the number of clocks.

6. The display timing control circuit as claimed in claim 1, wherein a converting ratio between the output frame rate and the input frame rate is of a predetermined value, and the clock adjusting unit generates an updated value of the clock divisor according to a current value of the clock divisor, number of pixels in an output frame, the predetermined value, and number of clocks of the output pixel clock signal which is associated with one period of the input vertical reference signal.

7. The display timing control circuit as claimed in claim 1, wherein the frequency shift detector determines the frequency shift according to a difference between the number of clocks of the output pixel clock signal which is associated with one period of the input vertical reference signal and number of pixels in an output frame.

8. The display timing control circuit as claimed in claim 7, wherein the clock divisor generator generates the updated value of the clock divisor when the frequency shift is greater than a first threshold value.

9. The timing control circuit as claimed in claim 8, wherein when the phase difference is greater than a second threshold, the clock adjusting unit performs phase reconfiguration to synchronize a next output reference time point of the output vertical reference signal with a next input reference time point of the input vertical reference signal.

10. The display timing control circuit as claimed in claim 9, wherein when the phase difference is greater than the second threshold value, the adjustment amount of the clock divisor is a coarse-adjustment amount; when the phase difference is not greater than the second threshold value, the adjustment amount of the clock divisor is a fine-adjustment amount.

11. The display timing control circuit as claimed in claim 10, wherein the coarse-adjustment amount is generated from dividing a current value of the clock divisor by a 2 to the power of n, where n is a positive integer.

12. The display timing control circuit as claimed in claim 10, wherein a unit of the fine-adjustment amount is generated from dividing a current value of the clock divisor by the number of pixels in an output frame.

13. The display timing control circuit as claimed in claim 1, wherein the phase difference detector determines the phase difference according to the number of clocks of the output pixel clock signal corresponding to a time difference between an input reference time point of the input vertical reference signal and an output reference time point of the output vertical reference signal.

14. A display timing control method, comprising:

generating an output pixel clock signal according to a reference clock signal and a clock divisor;

generating a display timing signal and an associated output vertical reference signal according to the output pixel clock signal, with the output vertical reference signal having an output frame rate; and adjusting the clock divisor according to the output pixel clock signal, the output vertical reference signal and an input vertical reference signal, with the input vertical reference signal having an input frame rate wherein adjusting the clock divisor comprises:

detecting a frequency shift between the output vertical reference signal and the input vertical reference signal;

generating an updated value of the clock divisor according to the frequency shift; and detecting a phase difference between the output vertical reference signal and the input vertical reference signal, determining a divisor adjustment amount of the clock divisor according to the phase difference.

15. The method as claimed in claim 14, wherein the display timing signal is an output vertical data enable signal, and the input vertical reference signal is associated with an input vertical data enable signal.

16. The method as claimed in claim 14, wherein the step of adjusting the clock divisor comprises:

generating an updated value of the clock divisor according to a current value of the clock divisor, number of pixels in an output frame, and number of clocks of the input pixel clock signal which is associated with one period of the input vertical reference signal.

17. The method as claimed in claim 16, wherein when the display timing signal is non-interlaced display timing, the updated value of the clock divisor is generated from multiplying a result of dividing the current value of the clock divisor by the number of pixels by the number of clocks.

18. The method as claimed in claim 16, wherein when the display timing signal is interlaced display timing, the updated value of the clock divisor is generated from multiplying a result of dividing the current value of the clock divisor by twice of the number of pixels by the number of clocks.

19. The method as claimed in claim 14, wherein a converting ratio between the output frame rate and the input frame rate is of a predetermined value, and adjusting the clock divisor comprises:

generating an updated value of the clock divisor according to a current value, the number of pixels in an output frame, the predetermined value, and the number of clocks of the output pixel clock signal corresponding to one period of the input vertical reference signal.

* * * * *